US005213848A

United States Patent [19]

Zurecki et al.

[11] Patent Number: 5,213,848

[45] Date of Patent: * May 25, 1993

[54] METHOD OF PRODUCING TITANIUM NITRIDE COATINGS BY ELECTRIC ARC THERMAL SPRAY

[75] Inventors: Zbigneiw Zurecki, Macungie; Edward A. Hayduk, Jr., Blandon; John G. North, Pottstown; Robert B. Swan, Bath; Kerry R. Berger, Lehighton, all of Pa.

[73] Assignee: Air Products and Chemicals, Inc., Allentown, Pa.

[ * ] Notice: The portion of the term of this patent subsequent to Nov. 19, 2008 has been disclaimed.

[21] Appl. No.: 727,511

[22] Filed: Jul. 9, 1991

Related U.S. Application Data

[63] Continuation-in-part of Ser. No. 477,400, May 6, 1990, Pat. No. 5,066,513.

[51] Int. Cl.[5] ..... B05D 3/06; B05D 1/04

[52] U.S. Cl. ..... 427/449; 427/580; 427/446; 427/126.1

[58] Field of Search ..... 427/37, 34, 35, 126.1, 427/423, 580, 449, 446; 428/908.8

[56] References Cited

U.S. PATENT DOCUMENTS 5,066,513 11/1991 Zurecki et al. ..... 427/37

FOREIGN PATENT DOCUMENTS 60-171664 9/1985 Japan .
1-55369 3/1989 Japan .

*Primary Examiner*—Shrive Beck
*Assistant Examiner*—Roy V. King
*Attorney, Agent, or Firm*—James C. Simmons; William F. Marsh

[57] ABSTRACT

Surfaces subject to wear and corrosion can have their service life increased by being coated with a composite coating applied by the electric arc thermal spray process using at least one titanium feed wire, optionally pre-nitrided, a second wire of a different metal, metal alloy ceramic or intermetalic compound and nitrogen in the arc spray gun.

9 Claims, 2 Drawing Sheets

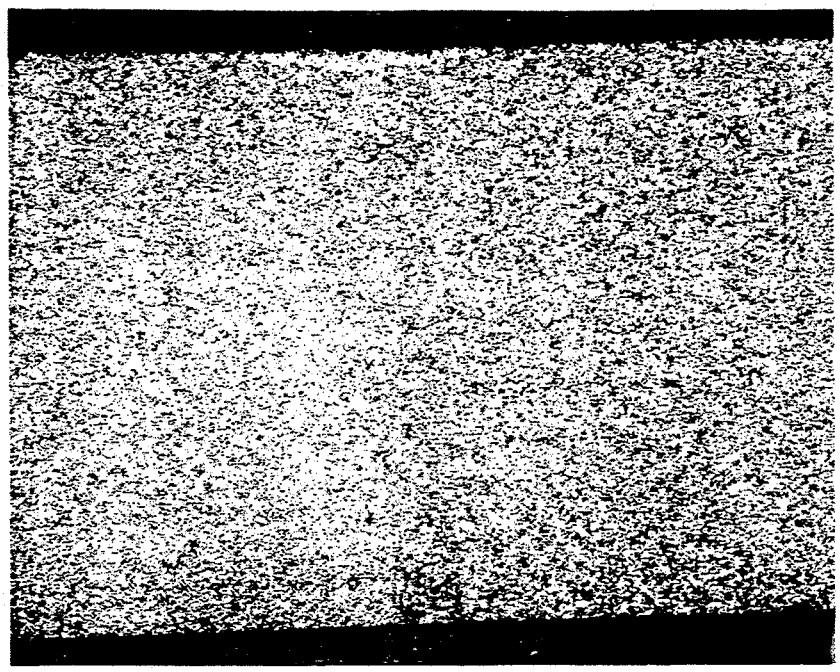
FIG. 2 AS SUPPLIED Ti WIRE (50x, ETCHED)
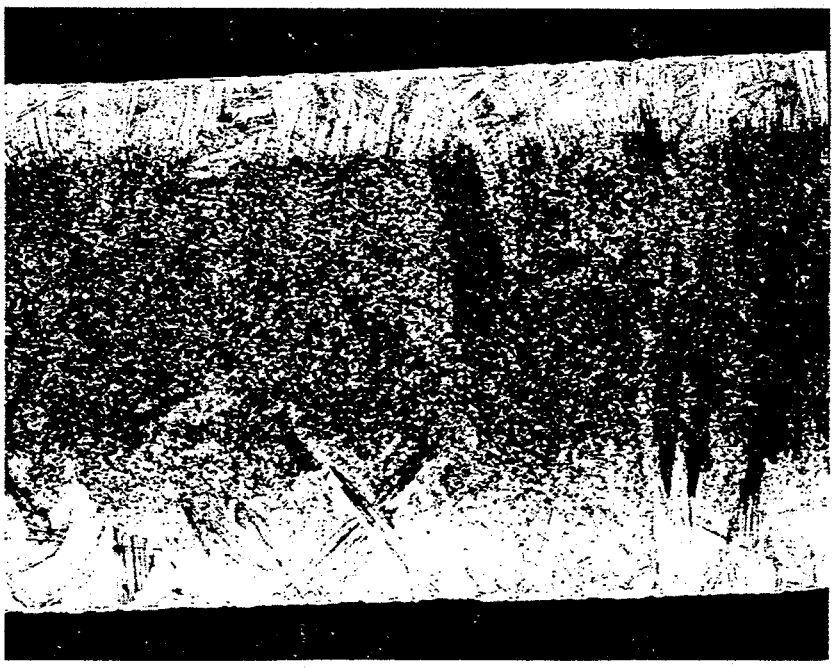
FIG. 3 PRE-NITRIDED Ti WIRE (50x. ETCHED)

METHOD OF PRODUCING TITANIUM NITRIDE COATINGS BY ELECTRIC ARC THERMAL SPRAY

This application is a continuation-in-part of U.S. patent application Ser. No. 07/477,400 filed May 6, 1990, now U.S. Pat. No. 5,066,513.

FIELD OF THE INVENTION

The present invention pertains to industrial articles such as screens for cominution devices which are normally subject to mechanical wear and corrosion during use and methods for extending the service life of such parts.

BACKGROUND OF THE INVENTION

Throughout all of the industrial sectors of the world many mechanical devices are subjected to wear caused by abrasion, erosion, and/or corrosion during their normal service life. Billions of dollars are spent by industry to replace components which fail prematurely because of excessive wear in inert and corrosive service environments. Many parts may be made to last longer if they were manufactured from harder, corrosive resistant materials however, the cost of doing so is often prohibited and can mean the difference between a successful operation and a unsuccessful operation because of excessive costs.

A number of methods are available for surface hardening or depositing corrosion and wear resistant materials on industrial parts. The oldest known methods are diffusion treatments, nitriding and carburizing of ferrous based materials. The disadvantage in using these techniques is that they involve subjecting the parts to elevated temperatures. Apart from the high costs associated with the energy and operation time, subjecting a part to elevated temperatures can cause size changes and loss of mechanical properties which would render the part unsuitable for use and/or would require a further heat treating operation and a subsequent cleaning operation to be performed after the surface treatment.

Electroplating, most commonly used to produce hard chromium or nickel coatings, involves cleaning the parts to be coated to a high degree and involves toxic solutions which are costly when disposed of in an environmentally safe manner.

Chemical and physical vapor deposition of coatings require high capital investment, high processing costs and are limited to very thin coatings and small parts. Of the thermal spray deposition methods which can be used to coat parts of unlimited size with coatings of unlimited thickness flame spraying often yields a porous coating with oxide inclusions.

Plasma spraying especially if performed in a vacuum or atmosphere chamber, will yield dense homogeneous coatings but is expensive and therefore limited in use.

High velocity detonation guns can deposit dense ceramic coatings on substrates but the equipment, feed powders and processing are very expensive.

Electric arc spraying with inert gases can produce dense, homogeneous coatings which bond well to a variety of substrate materials. Arc-sprayed titanium nitride which does not require high enthalpy flame is a cold process compared to the high heat input plasma and flame spray processes which can damage or distort the substrate material. Furthermore, the capital equipment and operating costs are less than one-half that of the plasma high velocity spraying methods and about order of magnitude less than that of the chemical vapor deposition. In electric arc spray of titanium nitride type coatings, disclosed in this invention, the surface to be coated requires no special preparation other than grit blasting.

SUMMARY OF THE INVENTION

In order to provide improved wear life for a part normally subject to abrasion, erosion and/or corrosion during use, it was discovered that a titanium nitride coating can be applied by the electric arc thermal spray process, wherein nitrogen is used as the propellant (atomizing) gas and a titanium wire as the feed material. Pre-nitriding the titanium wire results in a coating that is even harder and more wear resistant than would be found if the substrate were coated without having pre-nitrided the titanium wire.

The invention includes coatings nitrogen arc sprayed using two different wire materials if at least one of them is titanium wire. The titanium wire does not have to be pre-nitrided in all cases where a second wire selected from the group of ferrous metals, ferrous metal alloys, non-ferrous metals, excluding titanium, non-ferrous metal alloys, ceramics intermetallic compounds, special welding wires, e.g. cored wires and mixtures thereof. In cases where the titanium wire is not pre-nitrided it may be beneficial to anneal or heat treat the as-deposited cooling in nitrogen in order to enhance a $Ti_xN$ phase in the coating.

Substrates to which composite coatings have been applied include, by way of illustration only, metals, ceramics, carbon, graphite, plastics and carbon/graphite composites.

BRIEF DESCRIPTION OF THE DRAWING

FIG. 2 is a photomicrograph of the structure of titanium wire before treatment.

FIG. 3 is a photomicrograph of the structure of titanium wire after pre-nitriding.

DETAILED DESCRIPTION OF THE PREFERRED EMBODIMENT

Figure 1:
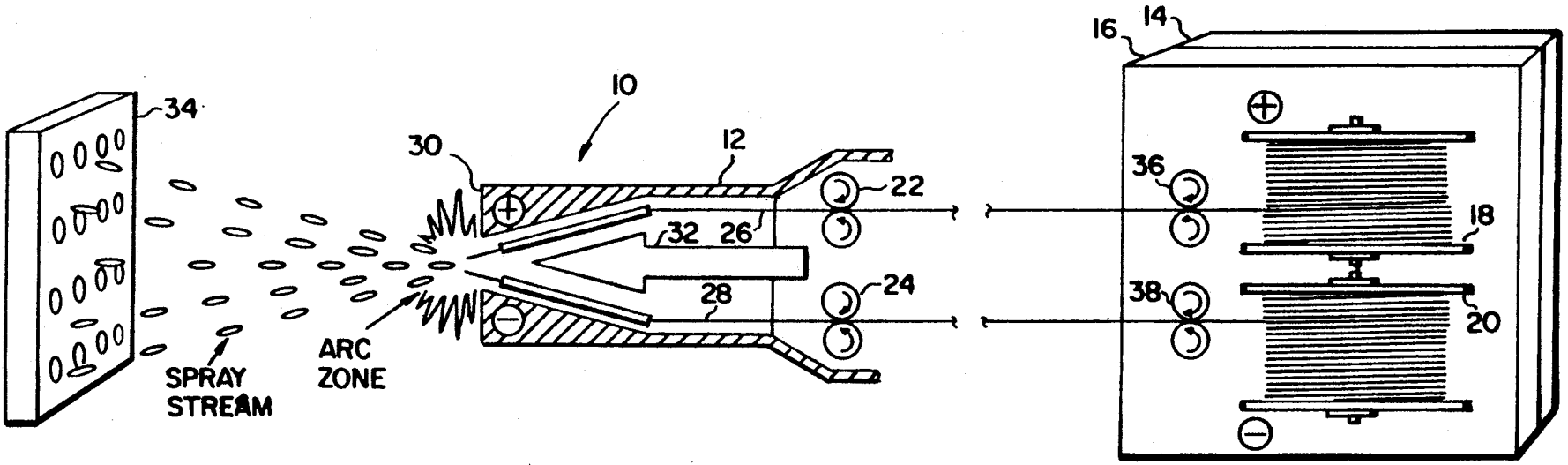
FIG. 1 is a schematic representation of a typical electric arc spray system employed to make the articles and practice the process of the present invention.

Increasing the service life of a part normally subjected to mechanical wear during use can provide a manufacturer and user with significant cost savings. For example, in the grinding of materials such as rubber and plastics for reformulating into compounds, doubling the service life of the screens used to classify the material in the impact mill (e.g., Hammermill) would be a significant benefit.

One method of enhancing the wear resistance of industrial parts would be to deposit a titanium nitride coating on the surfaces of the parts that are subject to wear. It has been discovered that if the electric arc spray process is used to apply such coatings and high purity nitrogen is substituted for air as a propelling gas the titanium wire is melted and the titanium is nitrided with minimum oxidation between the arc spraying device and the substrate to deposit a titanium nitride coating. The arc spray process can be used without an atmosphere chamber or a furnace or subsequent nitriding of the coating. A particularly effective coating is achieved if the titanium wire is nitrided prior to being used in the electric arc spray device.

The nitrogen used as the propelling (atomizing) gas during the electric arc thermal spray process reacts with droplets of molten titanium detached from the tip of the titanium feed wire to produce the titanium nitrogen compound in flight. As the molten droplets land on the surface of the article being coated they solidify thus forming a hard titanium nitride base coating that protects against wear and corrosion.

Electric arc spraying of a titanium coating utilizing nitrogen as a propelling gas is inexpensive as compared to deposition by plasma, high velocity combustion spraying, chemical vapor deposition and physical vapor deposition techniques. In addition, titanium nitride and titanium oxide are non-toxic as compared to many denser than Ti metals, e.g. chromium and nickel-phosphorous commonly used in other hard facing techniques, thus the coating is suitable for use in food and cosmetic processing equipment. Furthermore, arc spraying takes minutes rather than hours that may be required for other processes, leaves no toxic byproducts and requires a minimal capital investment.

As shown in FIG. 1 of the drawing, the arc spray system 10 includes an arc gun 12, a constant voltage power source 14, a control console 16 and a wire feed device represented by wire spools 18 and 20 respectively. The arc spray gun 12 includes two sets of feed rollers 22, 24 to move separate wires 26, 28 respectively, through the gun to the nozzle end 30 where due to electrical current of different polarities (e.g., as shown in the drawing) an arc is struck between the wires 26 and 28. As the wires melt due to the influence of the electrical arc, compressed nitrogen gas is introduced into the arc on 12 as shown by the arrow 32. The nitrogen gas exists the nozzle 30, where it causes the molten metal to be broken up into a stream of droplets. The compressed gas, in addition to atomizing the metal and sustaining electric arc, propels the atomized metal (spray stream) toward a substrate 34 such as a conventional Hammermill screen 34. During aerial traverse of the atomized titanium, reaction with nitrogen forms a titanium nitride compound.

The substrate 34 can be mounted vertically or horizontally and either it or the arc gun 12 can be oscillated to provide a uniform coating over the length of the electrode.

Wire feeders 18 and 20 can also include a pair of rollers 36, 38 to help feed the wire from the spools to the gun 12. The feed rolls in the gun and the wire feeds can either push, pull or use a combination of both techniques to move the wire through the arc gun 12.

It was found that while a conventional titanium nitride coating placed on the substrate by the thermal arc spray process using titanium wire and nitrogen gas produced coatings of enhanced wear resistance, if the as-received titanium wire was pretreated to increase the nitrogen content the resultant coating was harder and the life of the parts in service was, in many instances, increased.

The titanium wire pre-treatment was developed when it was realized that $N_2$-sprayed $Ti_xN$ coatings were both nitrogen (N) deficient and prone to in-flight oxidation. There were two additional reasons for wire pretreatment: (1) as-supplied Ti-wires were difficult to feed through arc-spray gun conduits, and a nitride coating on the wires was discovered to lower the wire feed-friction, (2) post-deposition nitrogen annealing of arc-sprayed $Ti_xN$ may not always be possible; some substrates may be sensitive to elevated temperatures and/or an excessively large mismatch may exist between thermal expansion coefficients of the $Ti_xN$ coating and substrate that will damage the coating, (e.g. $Ti_xN$-coating on st. steel-substrate).

The Experiments included selection of annealing conditions for Ti-wires, sprayability tests with the annealed wires, and evaluation of the coatings sprayed with the annealed wires. TABLE 1 below presents the selection process. The third step annealing was found to be optional and used for testing. The different microhardness (e.g., 269 vs. 150 VHN) on the cross-section of the $N_2$ annealed and initially 'hard' and 'soft' Ti-wires indicates that $N_2$ annealing can be at temperatures higher than 1000° C. TABLE 2 shows the 8-fold [N] pickup in the Ti-wire resulting from our 1000° C. $N_2$ annealing.

TABLE 1

Tests for Selection of N2 Annealing Conditions
J&W Belt Furnace, 25–29 Minutes Treatment
Time in Hot Zone, Dry House Gases

| Step | Condition | Objectives | Results |
|---|---|---|---|
| #1 | N2-10% H2 @ 1000° C. | Weaken the Ti-oxide film on Ti-wire with H2 and speedup the N2 diffusion into wire | Totally brittle wires, both the hard and the soft one; wire deformation is impossible |
| #2 | N2-pure @ 800° C. | Prevent the observed Ti-wire embrittlement | Both (H/S)* Ti-wires didn't change color or mech. properties |
| #3 | N2-pure @ 1000° C. | Increase Ti-nitriding kinetics but give up on the H2-activation of the wire surface | Both (H/S) Ti-wires exhibited yellow (TiN color) and a thin, uniform, smooth nitride developed on the wires |

*H/S, i.e. 'hard' and 'soft' Ti-wires, were two different types of the as-supplied feed material that was used throughout the tests. Both the materials were pure Ti, and the hardness difference resulted from the different degree of annealing at the end of the drawing process at the wire manufactures' site.

TABLE 2

Nitrogen Content in As-Supplied
and N2-Treated Ti (soft) Wire
J&W Belt Furnace, 25–29 Minutes Treatment
Time in Hot Zone. N2-pure @ 1000° C.

| As-Supplied | N2-Treated |
|---|---|
| 91 wppm | 790 wppm |

Initial sprayability tests showed that despite a yellow nitride post-annealing (nitride treated) coating, the $N_2$-treated Ti-wires can be melted, atomized, and deposited as well as the (untreated) as-supplied wires. Moreover, tests with continuously nitrogen annealed 'soft' wires show that the yellow nitride post-annealing coating actually smoothened the wire feeding into the gun which greatly improved the arc stability during the spraying.

$Ti_xN$ coatings were deposited using the $N_2$ annealed wires and compared to the coatings produced previously using the as-supplied wires and/or the $N_2$ post-deposition annealing. The appearance, surface roughness, self-bonding ability, and adhesion to the substrate (bend test) of the new coatings were the same as in the case of the coatings deposited in the past. However, the Knoop microhardness measurements revealed significant differences between the coatings. In the case of the 'hard' Ti feed wire, the coating deposited using the $N_2$ annealed wire was as hard as the coating which was applied by depositing essentially pure titanium followed by a post-deposition anneal in $N_2$ atmosphere. Both these coatings were much harder than the 'basic' coating produced with the as-supplied wire with no post-deposition annealing. Hardness of the $Ti_xN$ coating, produced with the $N_2$ annealed 'soft' Ti-wire, the highest in the series, was compared with those of the stainless and carbon steel substrates. The coating was 6.3 times harder than the stainless and 9 times harder than the carbon steel.

The $N_2$ wire pretreatment was found to improve hardness of the $Ti_xN$ coating by increasing the nitrogen content and improving the nitride stoichiometry (lower x). Nevertheless, the increased nitrogen content did not reduce the self-bonding ability of the $Ti_xN$ deposits.

Microhardness of the new coating is at least equivalent to that of the post-deposition annealed coatings, which makes the annealing of the coated parts unnecessary. Alternatively, both the pretreatment and post-deposition annealing steps can be used as two independent tools for the coating hardness control. It was also observed that the wire pretreatment improved the arc stability by lowering the wire friction in the gun conduits.

As to the wire, any technically pure, i.e. unalloyed, titanium wire with no special requirements, or specs on purity levels, e.g. no spec. on Fe, V, etc. can be used. Typically, a technically pure titanium wire should have no more than 100 ppm of nitrogen (on wt. basis). Any titanium physical condition, e.g. soft, hard, or half-hard is acceptable.

FIG. 2 is a photomicrograph of the structure of a typical wire before treatment.

Pre-nitriding the wire should impart the following characteristics:

(a) develop a golden colored TiN film on the surface of the treated wire, (b) increase nitrogen content, e.g. more than 500 ppm w/o, (c) the core of the treated wire should remain metallic in order to preserve the flexibility of the wire required for the feeding of the arc-spray gun from the reels. This means, the top limit for the nitrogen content in the wire is 20% w/o.

As shown in FIG. 3 the microstructure of the pre-nitrided (annealed) wire should show coarse circular grain growth from the surface toward the core of the wire with corresponding degrees of hardness (VHN) from the surface to the core.

According to one aspect of the present invention a uniform wear and corrosion resistant coating consisting primarily of titanium nitride can be deposited on a variety of substrate materials. The coating is deposited by electric arc spray using 0.062 or 0.030 inch diameter titanium wire that has been pretreated as set out above and nitrogen as the propelling (atomizing) gas. Nitrogen is substituted for high purity air as the propelling gas so that the titanium is further nitrided and oxidation is minimized. Two spools of titanium wire are fed into the gun 12 where they arc across at a potential difference of between 28 and 48 volts and 100–400 amps. Alternatively one spool of the wire may feed the spraying gun with another coating material which will form with the $Ti_xN$ alloy or pseudo-alloy coatings. This other material may include hard Fe, Cr, Ni, Mo, and W alloys and compounds as well as soft bonding non-ferrous metals and alloys. The coatings produced by the simultaneous use of the Ti and non-Ti wires offer lower hardness but higher impact resistance. The required spraying conditions remain unchanged. The nitrogen gas stream is feed to the nozzle at between 30 and 130 psig. The molten wire tips and the droplets react with the nitrogen gas and form the titanium nitride coating on the substrate 34. The stand-off distance between the gun and a substrate is between 3 and 8 inches. The substrate is grit blasted before spraying in order to increase the strength of the mechanical bond between the coating and the substrate. The coating itself can be deposited to a thickness ranging from 0.001 inches to several inches in depth.

Another aspect of the invention relates to $Ti_xN$ based ceramic or metal-matrix composite coatings for wear and corrosion protection of various substrates or articles. Pre-nitriding of the wire and/or nitriding of the as deposited coating performed for the pure $Ti_xN$ coatings can be used but are not necessary in preparing composite coatings according to the invention. The presence of the $Ti_xN$ component in the as-deposited coating permits improved wear and corrosion resistant coatings to deposited on metals, ceramics, plastic and carbon/graphites.

A number of experiments were conducted to demonstrate the effectiveness of the composite coatings of the present invention.

The combinations of wire and the operating parameters used to deposit the coatings as well as description of the as-deposited coatings are set out in Table 3.

TABLE 3

MATERIALS AND ELECTRIC ARE SPRAYING CONDITIONS USED FOR COATINGS PRESENTED IN EXAMPLES 1-5

| # | FEED MATERIALS: NEGATIVE WIRE | FEED MATERIALS: POSITIVE WIRE | COATING MATERIAL DESCRIPTION | ANTICIPATED COMPOSITION OF DEPOSITED COATING | ATOMIZING GAS | GAS BACK PRESSURE (PSIG) | NOZZLE TYPE AND GUN TYPE* | CURRENT (AMP) | CLOSED CIRCUIT VOLTAGE (VOLT) | GUN STANDOFF (INCHES) | OTHER* SPRAYING CONDITIONS | COATING THICKNESS AS-SPRAYED (INCHES) |
|---|---|---|---|---|---|---|---|---|---|---|---|---|
| 1 | Hastelloy B-2 Wire | Same as the Negative Wire | Metallic Alloy | Ni-28 Mo-2 Fe-1 Co-1 Cr-1 Mn (wt %) | $N_2$ | 85 ± 10 | ⅛" ID ± ⅛" ID | 150 ± 30 | 40 ± 5 | 5.0 ± 0.5 | Gun Traverse Speed Over the Part: 300 ipm | >0.020 |
| 2 | Prenitrided Ti Wire | Hastelloy B-2 Wire | Metal Matrix Composite | 50 mole % of TixN and 50 mole % of Hastelloy B-2 | $N_2$ | 85 ± 10 | As Above | 150 ± 30 | 40 ± 5 | 5.0 ± 0.5 | As Above | As Above |
| 3 | Prenitrided Ti wire | Same as the Negative Wire | Ceramic | $Ti_{1.7}N$ | $N_2$ | 95 ± 10 | As Above | 180 ± 30 | 36 ± 5 | 6.0 ± 0.5 | As Above | As Above |
| 4 | Prenitrided Ti Wire | Same as the Negative Wire | Ceramic | $Ti_{1.7}N$ + oxides | Air | 95 ± 10 | As Above | 180 ± 30 | 36 ± 5 | 6.0 ± 0.5 | As Above | As Above |
| 5 | Ti-Wire (not prenitrided) | Same as the Negative Wire | Ceramic or Cermet | $Ti_xN$, where $x < 1.7$ | $N_2$ | 95 ± 10 | As Above | 180 ± 30 | 36 ± 5 | 6.0 ± 0.5 | As Above | As Above |
| 6 | Cored Wire from Amtech, Inc.: 304 St. Steel Sheath and Alloyed Powder Containing Fe-50Cr-8B-3Si | Same as the Negative Wire | Amorphous or Nanocrystalline Metallic Alloy | Fe-30Cr-1.5 Si-2B (wt %) | $N_2$ | 60 ± 10 | As Above | 180 ± 30 | 36 ± 5 | 5.0 ± 0.5 | As Above | As Above |
| 7 | Cored Wire from Amtech, Inc.: 304 St. Steel Sheath and Alloyed Powder Containing Fe-50Cr-8B-3Si | Same as the Negative Wire | Amorphous or Nanocrystalline Metallic Alloy | Fe-30Cr-1.5 Si-2B (wt %) + oxides | Air | 60 ± 10 | As Above | 180 ± 30 | 36 ± 5 | 5.0 ± 0.5 | As Above | As Above |
| 8 | Ti-Wire (pre-nitrided) | Cored Wire used as in #6 | Metal Matrix Composite | 50 mole % of $Ti_xN$ and 50 mole % of Metalling Alloy of Example 6 | $N_2$ | 85 ± 10 | As Above | 150 ± 30 | 86 ± 5 | 5.0 ± 0.5 | As Above | As Above |
| 9 | Ti-Wire (pre-nitrided) | Cored Wire used as in #6 | Metal Matrix Composite | 50 mole % of $Ti_xN$ and 50 mole % of Metalling Alloy of Example 6 + oxides | Air | 85 ± 10 | As Above | 150 ± 30 | 86 ± 5 | 5.0 ± 0.5 | As Above | As Above |
| 10 | Alcro Wire from Miller Thermal: Fe-22Cr-4Al (wt %) | Same as the Negative Wire | Ferritic and/or Martensitic Stainless Steel | Fe-22Cr-4Al (wt %) | $N_2$ | 60 ± 10 | As Above | 180 ± 30 | 31 ± 5 | 6.0 ± 0.5 | As Above | As Above |
| 11 | Prenitrided Ti-Wire | Alcro Wire from Miller Thermal: Fe-22Cr-4Al (wt %) | Metal Matrix Composite | 50 mole % of $Ti_xN$ and 50 mole % of | $N_2$ | 85 ± 10 | As Above | 150 ± 30 | 36 ± 5 | 5.0 ± 0.5 | As Above | |

TABLE 3-continued

| # | FEED MATERIALS NEGATIVE WIRE | FEED MATERIALS POSITIVE WIRE | COATING MATERIAL DESCRIPTION | MATERIALS AND ELECTRIC ARE SPRAYING CONDITIONS USED FOR COATINGS PRESENTED IN EXAMPLES 1-5: ANTICIPATED COMPOSITION OF DEPOSITED COATING | ATOMIZING GAS | GAS BACK PRESSURE (PSIG) | NOZZLE TYPE AND GUN TYPE* | CURRENT (AMP) | CLOSED CIRCUIT VOLTAGE (VOLT) | GUN STANDOFF (INCHES) | OTHER* SPRAYING CONDITIONS | COATING THICKNESS AS-SPRAYED (INCHES) |
|---|---|---|---|---|---|---|---|---|---|---|---|---|
| 12 | Al-10 vol % $Al_2O_3$ Composite Wire from Alcan, Int. | Same as the Negative Wire | Metal Matrix Composite | Alcro St. Steel Al-10 vol % $Al_2O_3$ | Air | 80 ± 10 | As Above | 180 ± 20 | 36 ± 5 | 6.0 ± 0.5 | As Above | As Above |
| 13 | As above | As Above | As Above | As Above | $N_2$ | 80 ± 10 | As Above | 180 ± 20 | 36 ± 5 | 5.0 ± 0.5 | As Above | As Above |
| 14 | Prenitrided Ti Wire | Al-10 vol % $Al_2O_3$ Composite Wire from Alcan, Int. | Metal Matrix Composite | 50 mole % $Ti_xN$, 45 mole % Al and 5 mole % $Al_2O_3$ | $N_2$ | 80 ± 10 | As Above | 180 ± 20 | 36 ± 5 | 5.0 ± 0.5 | As Above | As Above |
| 15 | Prenitrided Ti Wire | Al-10 vol % $Al_2O_3$ Composite Wire from Alcan, Int. | Metal Matrix Composite | 50 mole % $Ti_xN$, 45 mole % Al and 5 mole % $Al_2O_3$ + oxides | Air | 80 ± 10 | As Above | 180 ± 20 | 36 ± 5 | 5.0 ± 0.5 | As Above | As Above |
| 16 | Ti-Wire (not prenitrided) | Al-10 vol % $Al_2O_3$ Composite Wire from Alcan, Int. | Metal Matrix Composite | 50 mole % $Ti_xN$, 45 mole % Al and 5 mole % $Al_2O_3$ | $N_2$ | 80 ± 10 | As Above | 180 ± 20 | 36 ± 5 | 5.0 ± 0.5 | As Above | As Above |

*Model 8830 arc spray gun manufactured by TAFA, Inc., Bow, N.H.

Note: Feed wires diameter was 1/16 inches in all presented examples. Other negative and/or positive wire diameters can also be used.

Set forth below in the form of Examples and Tables are the results of these experiments.

EXAMPLE 1

High wear rates and frequent production shutdowns were experienced in a continuous chemical vapor deposition (CVD) production process in which rolls fabricated from monolithic Hastelloy C-22 supplied by Haynes International were exposed simultaneously to $SiO_2$-powder wear and HCl-corrosion at elevated temperatures (30°-250° C.).

A composite coating was produced according to the present invention and deposited on the rolls thus solving the wear-corrosion problem. The coating selection was accomplished in two steps. First, the hardness of various materials resisting HCl corrosion was tested with the results set out in Table 3. It became clear that the $Ti_xN$ coating produced with the pre-nitrided Ti-wire was the hardest and it was followed by the composite coating comprising Hastelloy B-2 and $Ti_xN$ (pre-nitrided wire) components. The latter was produced according to the present invention by a simultaneous $N_2$-arc spraying of the Hastelloy B-2 and pre-nitrided Ti-wires.

In the second step, the corrosion resistance was screened with the results set out in Table 4. The Hastelloy B-2 coating was found to be the most corrosion resistant, the composite coating Hastelloy B-2/$Ti_xN$ (pre-nitrided wire) was second, and a high chromium corrosion resistant stainless steel, used as a control, was one order of magnitude worse. This result showed that the higher B-2 content the lower corrosion rate.

Combined, the results set out in Tables 4 and 5 indicated that the Hastelloy B-2/$Ti_xN$ (pre-nitrided wire) coating offered the best balance of the hardness, wear resistance, and HCl corrosion resistance (unnitrided $Ti_xN$/B-2 was not tested). Field tests and production runs confirmed the expected superiority of this coating over the uncoated C-22 rolls or the pure B-2 coating.

TABLE 4

HARDNESS* (SUPERFICIAL) ON MACHINED SURFACE

| Coating: | Hardness* |
|---|---|
| Hastelloy B-2 Arc-Spray Coating | 28 |
| Hastelloy B-2/$Ti_xN$ Composite Coating Arc-Sprayed with Pre-nitrided Ti-Wire | 55 |
| $Ti_xN$ Ceramic Coating Arc-Sprayed with Pre-nitrided Ti-Wire | 60 |
| $Ti_xN$ Ceramic Coating Arc-Sprayed with not Pre-nitrided Ti-Wire | 53 |
| Hastelloy C-22 Roll, Wrought, Uncoated | 24 |

*ROCKWELL 30N SCALE

TABLE 5

WEIGHT LOSS DURING 5.5 HOUR CORROSION TEST IN ULTRASONICALLY AGITATED AQUEOUS BATH CONTAINING 2% HCl

| Coating Material: | Wt. Loss (%) |
|---|---|
| Hastelloy B-2 Arc-Spray Coating | 0.04% |
| Hastelloy B-2/$Ti_xN$ Composite Coating Arc-Sprayed with Pre-nitrided Ti-Wire | 0.36% |
| Fe-30% Cr—Si—B Steel, Arc-Sprayed Control Coating | 3.50% |

EXAMPLE 2

A set of samples were prepared by arc-spraying coatings on carbon steel substrates and tested in as-sprayed (not ground) condition for a 3-body abrasion resistance using the dry-sand/ rubber-wheel ASTM G65-Practice D procedure. Table 6 lists the coatings, abrasion wear volume losses, and their superficial hardness.

TABLE 6

ABRASION RESISTANCE AND HARDNESS OF ARC-SPRAY COATINGS*
ASTM G65 - Practice D, 10 lbs. Load

| Wire Feed (Polarity) | Spraying Gas | Volume Loss ($cm^3$) | Superficial Hardness** |
|---|---|---|---|
| Ti-Wires No Pre-nitriding | $N_2$ | 0.2134 | 52.4 |
| Ti-Wires Pre-nitrided | $N_2$ | 0.1901 | 54.4 |
| Fe-22Cr-4Al Steel Wires Pre-nitrided | $N_2$ | 0.0570 | 19.8 |
| Ti-Wire negative with Fe-22Cr-4Al Second Wire (positive) | $N_2$ | 0.0354 | 44.0 |

*As-sprayed rough coating surface
**ROCKWELL 30N SCALE

The results show, that in the case of the dry-sand/rubber-wheel abrasion test and the superficial hardness measurements, the brittleness of the $Ti_xN$ coatings affects the performance, the pre-nitriding gives only a slight improvement, and another metallic binder needs to be incorporated into the coating. When a Fe-22Cr-4Al stainless steel coating was selected as the glue or matrix for the hard $Ti_xN$ particles, the abrasion wear resistance was significantly improved, even though the superficial hardness of the composite was lower than those of the pre-nitrided or not pre-nitrided $Ti_xN$ coatings. The similar effects of the other metallic binders were observed in the ASTM G65-Practice A tests on the coating samples ground first with an alumina wheel, Table 7.

TABLE 7

ABRASION RESISTANCE AND HARDNESS OF ARC-SPRAYED COATINGS*
ASTM G65-Practice A, 30 Lbs. Load

| Wire Feed (polarity) | Spraying Gas | Volume Less ($cm^3$) | Superficial Hardness** |
|---|---|---|---|
| Ti-Wires no-Pre-nitriding | $N_2$ | 0.4054–0.4423 | 53.4 ± 3.4 |
| Ti-Wire Pre-nitrided | $N_2$ | 0.2346–0.2559 | 59.6 ± 4.0 |
| Ti-Wire Pre-nitrided | air | 0.5402–0.5917 | 53.0 ± 3.7 |
| Cored-Wires from AMTECH | $N_2$ | 0.1318–0.1440 | 71.8 ± 1.8 |
| Cored-Wire from AMTECH (positive) and Ti-wire (negative) pre-nitrided | $N_2$ | 0.0555–0.0674 | 63.8 ± 3.6 |
| Cored-Wires from AMTECH | air | 0.1490–0.1628 | 70.6 ± 1.1 |
| Cored-Wire from AMTECH (positive and Ti-wire (negative) pre-nitrided | air | 0.0641–0.0700 | 64.8 ± 5.7 |
| Al-10% $Al_2O_3$ wires from Alcan | $N_2$ | 0.5689–0.6400 | below scale (6.4 on HR30T scale) |
| Al-10% $Al_2O_3$ wire from Alcan (positive) and Ti-wire (negative) pre-nitrided | $N_2$ | 0.2043–0.2806 | 14.5 ± 2.5 |
| Al-10% $Al_2O_3$ wires from Alcan | air | 0.5800–0.6796 | below scale (1.8 on HR 30T scale) |
| Al-10% $Al_2O_3$ wire from Alcan (positive) and Ti-wire (negative) | air | 0.2438–0.2653 | 14.0 ± 3.4 |

TABLE 7-continued

ABRASION RESISTANCE AND HARDNESS OF ARC-SPRAYED COATINGS* ASTM G65-Practice A, 30 Lbs. Load

| Wire Feed (polarity) | Spraying Gas | Volume Less ($cm^3$) | Superficial Hardness** |
|---|---|---|---|
| pre-nitrided | | | |

*Alumina wheel ground coating surface
**Rockwell 30N Scale

In the next step of wear resistance testing an impingement $Al_2O_3$ particle jet-erosion testing apparatus was set as follows:

| | |
|---|---|
| Jet Nozzle Diameter: | 0.046 cm |
| Standoff Distance: | 1.52 cm |
| Impact Angle: | 22.5° |
| $N_2$-Carrier Gas Supply Pressure: | $221 \times 10^3$ Pa Gauge |
| Test Temperature: | Room |
| Eroding Medium: | 50 μm $d_m$ Angular $Al_2O_3$ Particles |
| Eroding Medium Flowrate: | 1.6 g/minute |
| Erosion Rate Measure: | Depth of eroded-away cavity in μm/minute. |

The erosion test was performed on the same coatings as before and using the same condition, i.e., as-sprayed and rough (not ground) surface. Table 8 presents the erosion rate results.

TABLE 8

EROSION RATES FOR $N_2$-ARC SPRAYED COATINGS USING THE FOLLOWING FEED-WIRES; EROSION RATE IN μM/MINUTE

| Ti Wires No Pre-nitriding | Ti-Wires Pre-nitrided | Steel Wires (Fe-22Cr-4Al) | Pre-nitrided Ti-Wire with Fe-22Cr-4Al Second Wire |
|---|---|---|---|
| >132.1 | >132.1 | 13.0 | 10.7 |

The erosion test results are similar to the abrasion test results with respect to the role of a more ductile metallic binder for the hard but brittle $Ti_xN$ coating particles. Because the erosion jetting test is more sensitive to the coating brittleness and less to its hardness, the difference between the pre-nitrided and not pre-nitrided Ti-wire coatings becomes negligible, and the value of the present invention is clear only when the Ti-wire is sprayed with $N_2$ simultaneously with a second metal wire.

EXAMPLE 3

Widely used arc-sprayed aluminum coatings for galvanic corrosion protection of carbon steel parts suffer from the tendency for quick wearing on contact with moving particles, slurries, high velocity waters, etc. Improved aluminum coating wear resistance can be achieved by producing composite coatings comprising the galvanically protective but soft Al-metal matrix containing hard but inert ceramic particles.

Al-10 vol. % $Al_2O_3$ coatings were tried, but the resultant composite coatings, although better than the pure Al, were still softer than the carbon steel substrate they were used to coat. The $N_2$-arc-spray coating technique in accordance with the present invention was used which solved the hardness coating problem by incorporating the $Ti_xN$ particle into the Al-$Al_2O_3$ composite coating as shown by the data presented in Table 9.

TABLE 9

HARDNESS OF GALVANIC CORROSION PROTECTIVE COATINGS SPRAYED AT 80 PSI GAUGE PRESSURE, 200A-MELT RATE, AND 6-INCH STANDOFF

| Coating Material | Spraying Gas | Superficial Hardness* |
|---|---|---|
| Al-10% $Al_2O_2$ | Air | 43.0 |
| Al-10% $Al_2O_3$ | $N_2$ | 45.6 |
| Al-10% $Al_2O_3$ Wire Along with Pre-nitrided Ti-Wire | $N_2$ | 77.2 |
| Carbon Steel Plate, Hard Condition, Control Sample | N/A | 75.0 |

*ROCKWELL 15T SCALE

The galvanic corrosion protection of the $Ti_xN$ modified Al-$Al_2O_3$ coating was examined in a simple exposure test and the results are set forth in Table 10.

TABLE 10

CORROSION TEST SAMPLES AND CONDITIONS

Sample 1: Uncoated Carbon Steel Plate, Wrought Condition

Sample 2: 1-Side Al Coated Carbon Steel Plate

Sample 3: 1-Side Al-$Al_2O_3$ Composite Coated Carbon Steel Plate

Sample 4: 1-Side $Ti_xN$-Al-$Al_2O_3$ Composite Coated Carbon Steel Plate

First Exposure Step: 42-day immersion in Trexlertown, Pa., water, followed by brushing-off corrosion residues for samples.

Second Exposure Step: 19-day immersion in salt water, (0.51 g/80 ml), followed by brushing-off corrosion residues.

Third Exposure Step: 23-day immersion in salt water (1.00 g/40 ml), followed by brushing-off corrosion products.

The samples and corrosive medium were examined at the end of the last exposure step. The salt water was dark and contained rust suspensions only in the case of Sample 1, i.e., uncoated. This sample was also thoroughly corroded. The coated samples showed grayish stains on the coated side and red-brown rust stains on the uncoated side. There was no weight loss during the test in the case of samples 2 and 3; however, the uncoated sample lost 1.44% of its original weight, and the $Ti_xN$-Al-$Al_2O_3$ sample lost 0.56 wt. %. In conclusion, the $Ti_xN$ modified and hard composite coating of Sample 4 showed a somewhat reduced but still satisfactory ability to galvanically protect carbon steel substrates from corrosion even under the static (i.e., non-abrasive) conditions.

EXAMPLE 4

The $Ti_xN$-Al-$Al_2O_3$ coatings described in the preceding example were sprayed with $N_2$ under somewhat different conditions: the melting rate was reduced (180 amps were used instead of 200 amps), and the standoff distance between the gun nozzle and the coated part was decreased from 6' to 5". Two samples were produced: one with the pre-nitrided Ti-wire and the Al-10% $Al_2O_3$ wire, and the other with a not pre-nitrided Ti-wire and the Al-10% $Al_2O_3$ wire. Hardness of these two samples was measured using a higher load (Rockwell 30N Scale) superficial hardness tester as set forth in Table 10.

TABLE 11

SUPERFICIAL HARDNESS HR30N OF $Ti_xN$—Al—$Al_2O_3$ COMPOSITE COATINGS ARC-SPRAYED WITH $N_2$

| Coating Material | Hardness Range* |
|---|---|
| Pre-nitrided Ti-Wire and Al-10% $Al_2O_3$ | 12.2–17.0 |
| Not Pre-nitrided Ti-Wire and Al-10% $Al_2O_3$ Wire | 13.4–18.2 |
| Two Al-10% $Al_2O_3$ Wires | Below Scale |

*ROCKWELL 30N SCALE

The foregoing results show that under these new $N_2$-spraying conditions the use of pre-nitrided Ti-wire does not necessarily improve the composite coating hardness. The shorter standoff distance, the higher $N_2$-atomizing gas to feed wires mass ratio, and the pre-existence of the $Al_2O_3$ ceramic particles in one of the feed wires made it unnecessary to pre-nitride the Ti-wire in order to get the best coating hardness.

EXAMPLE 5

Hardness of $Ti_xN$ coatings can be increased by pre-nitriding the Ti feed wire and/or by a $N_2$-atmosphere post-annealing of the coating along with its substrate. An experiment was performed in which a $Ti_xN$ coating resulting from the $N_2$-arc spraying of pre-nitrided Ti-wire was post-annealed under pure $N_2$-atmosphere at 250° C. for 21 hours. The hardness of the coating increased which is explained by the further increase in the nitrogen content of the $Ti_xN$ coating as shown by the data in Table 12.

TABLE 12

MICROHARDNESS OF POST-ANNEALED $Ti_xN$ COATING, VICKERS MICROHARDNESS

| $Ti_xN$ Coating Condition | Indentor Load in gms, 15 sec | Average Value | Standard Deviation |
|---|---|---|---|
| As-Sprayed with | 25 | 1,142 | 121 |
| Pre-Nitrided | 100 | 1,220 | 084 |
| Ti-Wire | 300 | 995 | 202 |
| $N_2$-Post | 25 | 1,489 | 296 |
| Annealed | 100 | 1,485 | 281 |
| After Spraying | 300 | 1,088 | 112 |

Coated parts have shown increased wear and corrosion resistance. Specifically, screens from Hammermills used to cryogenically grind rubber were coated under the above condition with three passes used to deposit a coating having a nominal thickness of 0.012 inches. Screens coated according to the invention have shown service lives between 2 and 20 times as long as uncoated screens. Corrosion exposure tests were performed by placing coated parts in seawater for extended periods of time with no apparent effect on the coating.

The titanium-nitrogen compound forming the coating which provides increased wear and corrosion-resistance over that of the metallic substrate can show a coating hardness in the range of between 860 to 1500 (VHN) micro hardness as measured by the Vickers method. This is harder by a factor of between 5 and 11 than the common steel substrate materials.

The process of the present invention can be applied to any material that will accept a titanium nitride bonded coating. The coatings will be effective to increase the wear resistance and can be placed on the substrate by an economical method. In addition to Hammermill screens the process of the present invention was applied to an air-jet pulverizer which is used to grind metal salt material. Previous attempts by the user to grind a metal salt material have resulted in graying of the light material due to erosion of the interior surfaces of the mill. Coating a laboratory mill resulted in grinding of the salt material with no apparent contamination since there was no graying of the white material produced.

Wear clips from a centrifugal kelp processing machine were coated according to the present invention and were found to last twice as long as parts which the user had coated with tungsten carbide.

Having thus described our invention what is desired to be secured by Letters Patent of the United States is set forth in the appended claims.

We claim:

1. A method of improving the corrosion and mechanical wear resistance of a substrate comprising the steps of:

exposing said substrate to the effluent from an electric arc thermal spray gun using two wires in said gun, one wire being titanium and the other being selected from the group consisting of ferrous metals, ferrous metal alloys, non-ferrous metals excluding titanium, non-ferrous metal alloys, ceramics, intermetallic compounds, cored welding wires and combinations thereof, and nitrogen gas as the atomizing/propelling gas, whereby a coating of titanium nitride particles embedded in a matrix formed from the second wire is produced on said substrate.

2. A method according to claim 1 wherein said coating has a thickness of at least 0.001 inches.

3. A method according to claim 1 wherein the electric arc thermal spray gun is operated to produce a coating having Ti containing particles with a titanium to nitrogen ratio of between 1 and 2.

4. A method according to claim 1 wherein said electric arc thermal spray gun is operated with a current supply between 100 and 400 amperes.

5. A method according to claim 1 wherein the distance from the electric arc thermal spray gun to said substrate is set at the minimum spacing to prevent overheating of said substrate.

6. A method according to claim 4 wherein said spacing is between 3 and 8 inches.

7. A method according to claim 1 wherein said titanium wire is annealed in nitrogen to increase the nitrogen content of the wire at least 500 ppm.

8. A method of improving the corrosion and mechanical wear resistance of a substrate comprising the steps of:

exposing said substrate to the effluent from an electric arc thermal spray gun using two wires in said gun, one wire being titanium and the other being selected from the group consisting of ferrous metals, ferrous metal alloys, non-ferrous metals excluding titanium, non-ferrous metal alloys, ceramics, intermetallic compounds, cored welding wires and combinations thereof, and nitrogen gas as the atomizing/propelling gas, whereby a coating of titanium nitride particles embedded in a matrix formed from the second wire is produced on said substrate; and heat treating said substrate in a nitrogen atmosphere after said coating is produced on said substrate.

9. A method of improving the corrosion and mechanical wear resistance of a substrate comprising the steps of:

exposing said substrate selected from the group consisting of metals, ceramics, carbon, graphite, plastics and carbon/graphite composites to the effluent from an electric arc thermal spray gun using two wires in said gun, one wire being titanium and the other being selected from the group consisting of ferrous metals, ferrous metal alloys, non-ferrous metals excluding titanium, non-ferrous metal alloys, ceramics, intermetallic compounds, cored welding wires and combinations thereof, and nitrogen gas as the atomizing/propelling gas, whereby a coating of titanium nitride particles embedded in a matrix formed from the second wire is produced on said substrate.

* * * * *